US006527234B1

(12) United States Patent
Kovacik

(10) Patent No.: US 6,527,234 B1
(45) Date of Patent: Mar. 4, 2003

(54) FOREARM/WRIST/MOUSE SUPPORT SYSTEM

(76) Inventor: Peter T. Kovacik, 6641 Sambar Cir., Cypress, CA (US) 90630

( * ) Notice: Subject to any disclaimer, the term of this patent is extended or adjusted under 35 U.S.C. 154(b) by 0 days.

(21) Appl. No.: 09/658,529

(22) Filed: Sep. 9, 2000

Related U.S. Application Data

(63) Continuation-in-part of application No. 09/247,966, filed on Feb. 10, 1999.

(51) Int. Cl.[7] ..... B43L 15/00

(52) U.S. Cl. ..... 248/118.1; 248/118.3; 248/118.5; 248/118; 248/346.01; 248/346.02; 108/93; 108/137

(58) Field of Search ..... 248/118, 118.3, 248/118.5, 346.01, 346.02, 678, 917, 924, 346.07; 108/93, 137, 50.02, 143, 50.01; 400/718, 715; 312/208.3, 208.1, 231, 330.1; 40/374

(56) References Cited

U.S. PATENT DOCUMENTS 64,170 A * 4/1867 Gaasbeek ..... 248/118
1,465,244 A * 8/1923 Hager ..... 248/118
1,524,767 A * 2/1925 Vandervoort ..... 248/118
5,188,321 A * 2/1993 Hirschenson et al. ..... 248/118
5,452,876 A * 9/1995 Hatcher ..... 248/441.1
5,628,482 A * 5/1997 Iravantchi et al. ..... 248/118
5,655,743 A * 8/1997 Gillis ..... 248/346.01
5,901,934 A * 5/1999 Wilson ..... 248/346.01
6,003,446 A * 12/1999 Leibowitz ..... 108/43
6,045,098 A * 4/2000 Timm ..... 248/118
6,244,546 B1 * 1/2001 Plamondon ..... 248/118

* cited by examiner

*Primary Examiner*—Kimberly Wood

(57) ABSTRACT

A forearm/wrist/mouse support system comprises a panel formed in a generally rectilinear configuration having a front, rear, and lateral side edges and a lower surface positionable on the upper surface of the desk. A recess of a generally rectilinear configuration is formed in the panel and extends upwardly from its lower surface to a location adjacent to the upper surface. A support plate in a generally rectilinear configuration for the arm and wrist of a user and a computer mouse has a top, a bottom, a front, a back and parallel sides and is slidably received within the recess for movement between an operative orientation wherein it is pulled forwardly to overlie a portion of the desk and also forwardly of the desk and an inoperative within the recess.

2 Claims, 2 Drawing Sheets

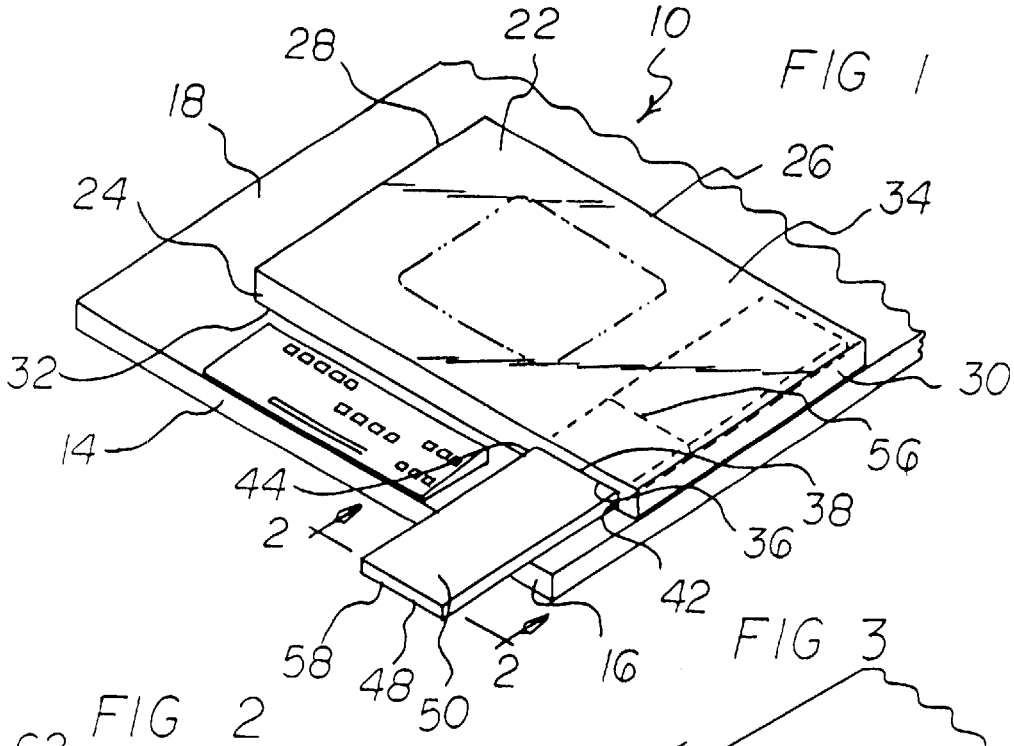
FIG 1
FIG 2
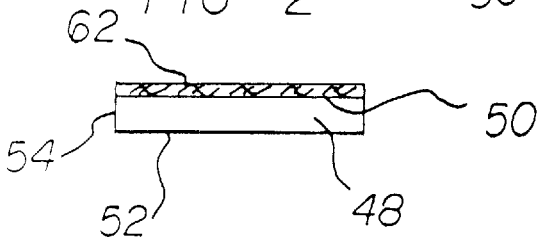
FIG 3
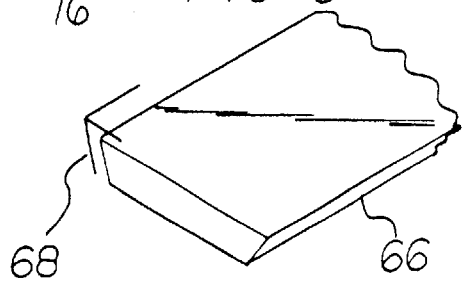
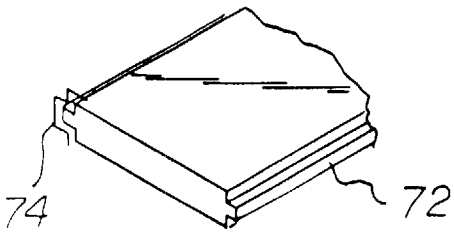
FIG 4
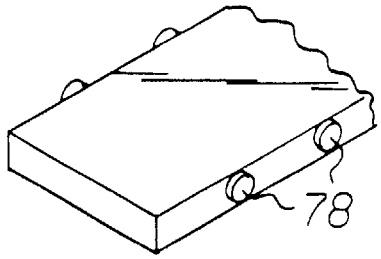
FIG 5
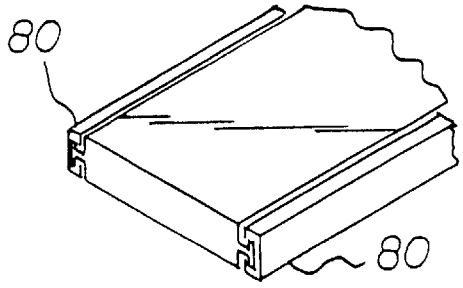
FIG 6

FIG 7
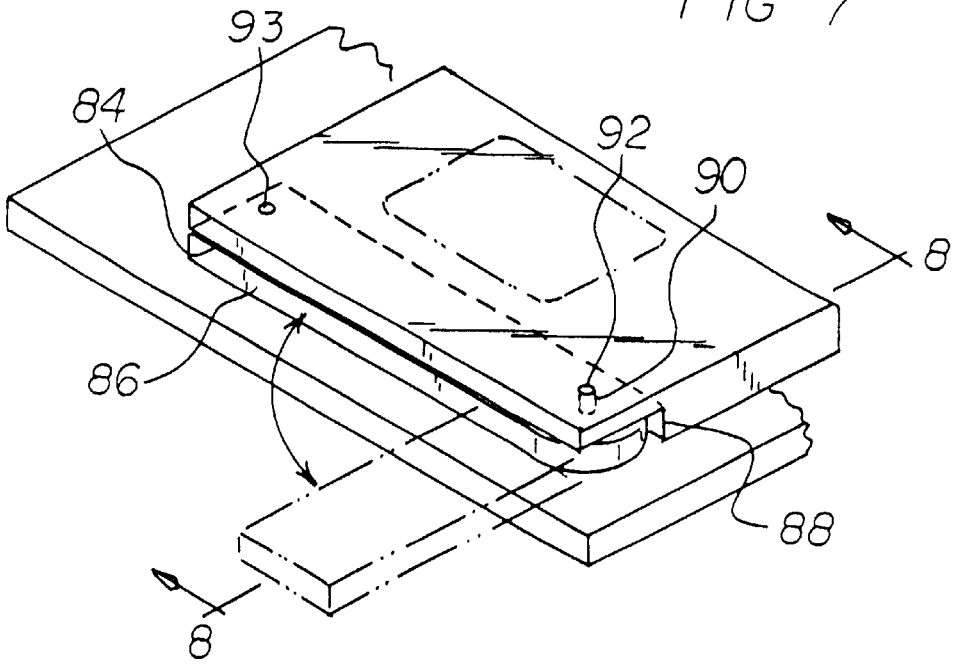
FIG 8
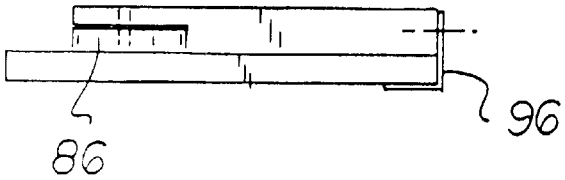
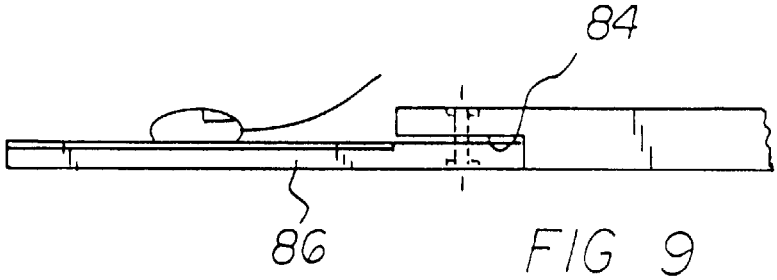
FIG 9
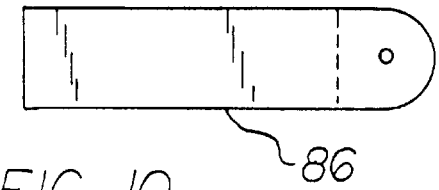
FIG 10

FOREARM/WRIST/MOUSE SUPPORT SYSTEM

RELATED APPLICATIONS

This application is a continuation in part of U.S. patent application Ser. No. 09/247,966 filed Feb. 10, 1999.

BACKGROUND OF THE INVENTION

1. Field of the Invention

The present invention relates to a forearm/wrist/mouse support system and more particularly pertains to providing comfort to a user of a computer with a mouse.

2. Description of the Prior Art

The use of computer accessories of known designs and configurations is known in the prior art. More specifically, computer accessories of known designs and configurations previously devised and utilized for the purpose of assisting computer users through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,158,257 issued Oct. 27, 1992 to Wilson discloses a keyboard support. U. S. Pat. No. 5,655,743 issued Aug. 12, 1997 to Gillis discloses a keyboard tray. Lastly, U.S. Pat. No. 5,901,934 issued May 11, 1999 to Wilson discloses a retractable surface support.

While these devices fulfill their respective, particular objectives and requirements, the aforementioned patents do not describe a forearm/wrist/mouse support system that allows providing comfort to a user of a computer with a mouse.

In this respect, the forearm/wrist/mouse support system according to the present invention substantially departs from the conventional concepts and designs of the prior art, and in doing so provides an apparatus primarily developed for the purpose of providing comfort to a user of a computer with a mouse.

Therefore, it can be appreciated that there exists a continuing need for a new and improved forearm/wrist/mouse support system which can be used for providing comfort to a user of a computer with a mouse. In this regard, the present invention substantially fulfills this need.

SUMMARY OF THE INVENTION

In view of the foregoing disadvantages inherent in the known types of computer accessories of known designs and configurations now present in the prior art, the present invention provides an improved forearm/wrist/mouse support system. As such, the general purpose of the present invention, which will be described subsequently in greater detail, is to provide a new and improved forearm/wrist/mouse support system and method which has all the advantages of the prior art and none of the disadvantages.

To attain this, the present invention essentially comprises a desk. The desk has a peripheral edge including a front edge. The desk also has an enlarged upper surface for the support of a computer keyboard and other computer related component. Next provided is a rigid panel. The rigid panel is formed in a generally rectilinear configuration. The rigid panel has a front edge and a parallel rear edge. The rigid panel also has parallel lateral side edges between the front and rear edges. The rigid panel also has a lower surface positioned on the upper surface of the desk. The rigid panel also has a parallel upper surface for the receipt of a computer monitor. A recess of a generally rectilinear configuration is formed in the panel. The recess extends upwardly from the lower surface of the panel to a location adjacent to the upper surface adjacent to one side edge of the panel. The recess is bounded on the bottom by the upper surface of the desk and on the top by a rectangular surface spaced downwardly from the upper surface of the panel. The recess is not bounded in the back so as to allow reversal of the panel for left handed usage. The recess is bounded on the sides by parallel rectangular side surfaces. One side face is spaced a small distance from one side edge of the panel. The other side face is spaced a predetermined spacing from the first side face. The predetermined distance is between about 10 and 20 percent of the length of the front edge of the panel. Lastly provided is a support plate for the arm and wrist of a user and a computer mouse. The support plate is in a generally rectilinear configuration. The plate has a top and a bottom and sides defining a length slightly greater than the side and top surfaces of the recess. The plate has a back and a front and sides which define a height slightly less than the height of the rear and side surfaces of the panel. The support plate also has a front and top and back which define a width slightly less than the width between the side surfaces of the recess. A soft layer is secured upon the top of the plate. The support plate is slidably received within the recess for movement parallel with the side edges of the panel between an operative orientation wherein it is pulled forwardly to overlie a portion of the desk and also forwardly of the desk and an inoperative orientation wherein the majority of the plate is within the recess.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved forearm/wrist/mouse support system which has all of the advantages of the prior art computer accessories of known designs and configurations and none of the disadvantages.

It is another object of the present invention to provide a new and improved forearm/wrist/mouse support system which may be easily and efficiently manufactured and marketed.

It is further object of the present invention to provide a new and improved forearm/wrist/mouse support system which is of durable and reliable constructions.

An even further object of the present invention is to provide a new and improved forearm/wrist/mouse support system which is susceptible of a low cost of manufacture with regard to both materials and labor, and which accordingly is then susceptible of low prices of sale to the consuming public, thereby making such forearm/wrist/mouse support system economically available to the buying public.

Even still another object of the present invention is to provide a forearm/wrist/mouse support system for providing comfort to a user of a computer with a mouse.

Lastly, it is an object of the present invention to provide a new and improved A forearm/wrist/mouse support system comprises a panel formed in a generally rectilinear configuration having a front, rear, and lateral side edges and a lower surface positionable on the upper surface of the desk. A recess of a generally rectilinear configuration is formed in the panel and extends upwardly from its lower surface to a location adjacent to the upper surface. A support plate in a generally rectilinear configuration for the arm and wrist of a user and a computer mouse has a top, a bottom, a front, a back and parallel sides and is slidably received within the recess for movement between an operative orientation wherein it is pulled forwardly to overlie a portion of the desk and also forwardly of the desk and an inoperative orientation within the recess.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the forearm/wrist/mouse support system for providing comfort to a user of a computer with a mouse constructed in accordance with the principles the present invention.

FIG. 2 is a cross sectional view taken along line 2—2 of FIG. 1.

FIGS. 3 4, and 5 illustrate alternate embodiments of the invention.

FIG. 6 is an extended illustration of the FIG. 5 embodiment.

FIG. 7 is a perspective illustration of another alternate embodiment of the invention.

FIG. 8 is a cross sectional view taken along line 8—8 of FIG. 7.

FIG. 9 is a cross sectional view taken along line 9—9 of FIG. 7.

FIG. 10 is an elevational view of the panel of FIGS. 7 through 9.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved forearm/wrist/mouse support system embodying the principles and concepts of the present invention and generally designated by the reference numeral 10 will be described.

The present invention, the forearm/wrist/mouse support system 10 is comprised of a plurality of components. Such components in their broadest context include a panel, a recess, and a support plate. Such components are individually configured and correlated with respect to each other so as to attain the desired objective.

First provided is a desk 14. The desk has a peripheral edge including a front edge 16. The desk also has an enlarged upper surface 18 for the support of a computer keyboard and other computer related components.

Next provided is a rigid panel 22. The rigid panel is formed in a generally rectilinear configuration. The rigid panel has a front edge 24 and a parallel rear edge 26. The rigid panel also has parallel lateral side edges 28, 30 between the front and rear edges. The rigid panel also has a lower surface 32 positioned on the upper surface of the desk. The rigid panel also has a parallel upper surface 34 for the receipt of a computer monitor.

A recess 36 of a generally rectilinear configuration is formed in the panel. The recess extends upwardly from the lower surface of the panel to a location adjacent to the upper surface adjacent to one side edge of the panel. The recess is bounded on the bottom by the upper surface of the desk and on the top by a rectangular surface 38 spaced downwardly from the upper surface of the panel. The recess is not bounded in the back so as to allow reversal of the panel for left handed usage. The recess is bounded on the sides by parallel rectangular side surfaces 42, 44. One side face 42 is spaced a small distance from one side edge of the panel. The other side face 44 is spaced a predetermined spacing from the first side face 42. The predetermined distance is between about 10 and 20 percent of the length of the front edge of the panel.

Lastly provided is a support plate 48 for the arm and wrist of a user and a computer mouse. The support plate is in a generally rectilinear configuration. The plate has a top 50 and a bottom 52 and sides 54 defining a length slightly greater than the side and top surfaces of the recess. The plate has a back 56 and a front 58 and sides 54 which define a height slightly less than the height of the rear and side surfaces of the panel. The support plate also has a front 58 and top 50 and back 56 which define a width slightly less than the width between the side surfaces of the recess. A soft layer 62 is secured upon the top of the plate. The support plate is slidably received within the recess for movement parallel with the side edges of the panel between an operative orientation wherein it is pulled forwardly to overlie a portion of the desk and also forwardly of the desk and an inoperative orientation wherein the majority of the plate is within the recess.

In an alternate embodiment of the invention, the sides of the plate are formed with laterally extending trapezoidal wings 66 received within similarly shaped slots 68 formed in the side surfaces of the panel. Note FIG. 3.

As shown in FIG. 4, in another alternate embodiment, the sides of the plate are formed with laterally extending rectilinear wings 72 received within similarly shaped slots 74 formed in the side surfaces of the panel. This is a tongue and groove arrangement.

A further alternate embodiment is shown in FIGS. 5 and 6. In this embodiment, the sides of the plate are formed with laterally extending rollers 78 received within rails 80 formed in the side surfaces of the panel.

Another alternate embodiment is shown in FIGS. 7 through 10. The recess 84 extends across the entire front edge of the panel. In this embodiment, the plate 86 is formed with a semicircular back 88. The plate 86 may also have a soft layer on its upper surface as in the primary embodiment. An aperture 90 extends through the axis of rotation of the rear of the plate and through the panel there above. A pivot pin 92 extends through the aperture to allow the pivoting of the plate with respect to the panel between an operative orientation wherein it is pulled forwardly to overlie a portion of the desk and also forwardly of the desk and an inoperative orientation wherein the plate is within the recess. A second aperture 93 on the opposite side allows for positioning for left handed usage. A plug is adapted to fill the unused aperture.

Shown in this embodiment is a clamp 96. Such clamp is to provide better support between the panel and the desk or other recipient surface. A plurality of such clamps could be utilized. A plurality of such clamps could be utilized. It may take the form of a C-clamp or any other conventional device for such holding and securement purposes. It is also preferably employed in the first embodiment of FIGS. 1–6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A forearm/wrist/mouse support system for providing comfort to a user of a computer with a mouse comprising, in combination:

a desk having a peripheral edge including a front edge and having an enlarged upper surface for the support of a computer keyboard and other computer related components;

a rigid panel formed in a generally rectilinear configuration having a front edge and a parallel rear edge and having parallel lateral side edges there between and having a lower surface removably positioned on the upper surface of the desk and a parallel upper surface for the receipt of a computer monitor thereon and with a space for a keyboard on the upper surface of the desk in front of the rigid panel;

a recess of a generally rectilinear configuration formed in the panel and extending upwardly from its lower surface to a location adjacent to the upper surface adjacent to one side edge of the panel, the recess being totally bounded on the bottom by the upper surface of the desk and on the top by a rectangular surface spaced downwardly from the upper surface of the panel and on the sides by parallel rectangular side surfaces, one side face being spaced a small distance from one side edge of the panel and the other side face being spaced a predetermined spacing from the one side face, the predetermined distance being between about 10 and 20 percent of the length of the front edge of the panel; and a support plate in a generally rectilinear configuration for the arm and wrist of a user and a computer mouse, the plate having a top and a bottom and sides defining a length slightly greater than the side and top surfaces of the recess and having a back and a front and sides defining a height slightly less than the height of the rear and side surfaces of the panel and having a front and top and back defining a width slightly less than the width between the side surfaces of the recess, a soft layer secured upon the top of the plate and being slidably received within the recess for movement parallel with the side edges of the panel between an operative orientation wherein it is pulled forwardly to overlie a portion of the desk and also forwardly of the desk and an inoperative orientation wherein the majority of the plate is within the recess.

2. A forearm/wrist/mouse support system comprising:

a planar recipient surface having an upper surface;

a panel formed in a generally rectilinear configuration having a front, rear, and lateral side edges there between and having a lower surface removably positionable on the upper surface of the recipient surface with a space for a keyboard on the recipient surface in front of the panel;

a recess of a generally rectilinear configuration formed in the panel and extending across the entire front edge of the panel and upwardly from its lower surface to a location adjacent to the upper surface, the recess being totally bounded on the bottom by the upper surface of the planar recipient surface and on the top by a rectangular surface spaced downwardly from the upper surface of the panel and at least one side by a side surface; and a support plate in a generally rectilinear configuration for the arm and wrist of a user and a computer mouse, the plate having a top and a bottom and a front and a semicircular back and parallel sides and with an aperture extending through an axis of rotation of the rear of the plate and through the panel there above and with a pivot pin extending through the aperture to allow the pivoting of the plate with respect to the panel, the support plate being slidably received within the recess for movement between an operative orientation wherein it is pulled forwardly to overlie a portion of the recipient surface and also forwardly of the recipient surface and an inoperative orientation wherein the plate is within the recess.

* * * * *